US005524594A

United States Patent [19]

D'Alessandro

[11] Patent Number: 5,524,594

[45] Date of Patent: Jun. 11, 1996

[54] MOTOR FUEL PERFORMANCE ENHANCER

[75] Inventor: Gianni D'Alessandro, Brookfield, Conn.

[73] Assignee: E.P.A. Ecology Pure Air, Inc., Bridgetown, Barbados

[21] Appl. No.: 303,042

[22] Filed: Sep. 8, 1994

Related U.S. Application Data

[63] Continuation-in-part of Ser. No. 164,126, Dec. 8, 1993, abandoned.

[51] Int. Cl.[6] ..... F02B 75/12

[52] U.S. Cl. ..... 123/538

[58] Field of Search ..... 123/536, 537, 123/538, 1, 1 A, 3; 431/2

[56] References Cited

U.S. PATENT DOCUMENTS

| | | | |
|---|---|---|---|
| 4,267,976 | 5/1981 | Chatwin | 123/538 |
| 4,715,325 | 12/1987 | Walker | 123/538 |
| 4,930,483 | 6/1990 | Jones | 123/538 |
| 5,013,450 | 5/1991 | Gomez | 123/538 |
| 5,044,346 | 9/1991 | Tada et al. | 123/538 |
| 5,059,217 | 10/1991 | Arroyo et al. | 123/538 |
| 5,092,303 | 3/1992 | Brown | 123/538 |
| 5,197,446 | 3/1993 | Daywalt | 123/538 |
| 5,249,552 | 10/1993 | Brooks | 123/538 |

*Primary Examiner*—Marguerite Macy
*Attorney, Agent, or Firm*—Baker & Daniels

[57] ABSTRACT

A performance enhancement device for motor fuels. The device include a filter canister which is positioned in the vehicle fuel line. The filter canister includes a quantity of catalytic metals which include tin, antimony and lead. As the fuel passes through the filter canister and contacts the catalytic metals, which must be attached to a metallic mesh by binders, the molecular structure of the fuel is reorganized. Fuels so treated exhibit higher combustibility, which results in greater fuel economy and reduced exhaust emissions.

18 Claims, 5 Drawing Sheets

MOTOR FUEL PERFORMANCE ENHANCER

This application is a continuation-in-part of U.S. patent application Ser. No. 164,126, filed Dec. 8, 1993, abandoned.

FIELD OF THE INVENTION

This invention relates to fuel enhancers and will have application to a device adapted for connection to a motor vehicle fuel line, which device enhances the performance characteristics of the fuel and reduces exhaust emissions.

BACKGROUND OF THE INVENTION

For years, vehicle engine designers have sought to improve engine design to enhance fuel economy and reduce exhaust emissions. Stringent governmental regulation, both at the state and federal level, has forced vehicle designers to constantly improve both engine and vehicle designs to meet the standards set out in the Clean Air Acts, and in the regulations governing fuel mileage minimum requirements. Engine re-design often involves sacrificing available horsepower, while vehicle re-design often entails cutting size and weight of the vehicle to increase the mileage. Obviously, altering the designs of vehicles and vehicle engines is done at enormous expense and results in higher prices to consumers.

Some attempts have been made to increase the performance of the fuel itself, before the fuel reaches the combustion chamber in the engine. Previous technology in the area of motor fuels has been confined to concepts involving generation of magnetic fields in the fuel line. This technology has proved largely unsuccessful.

During World War II, Rolls Royce engineer Henri Broquet developed a catalytic system which was added to the fuel tanks of Hurricane fighter aircraft. The catalytic system allowed the high compression aircraft engines to operate successfully on all grades of fuel available at the time. To date, no catalytic system is believed to have been developed for motor vehicle fuels.

SUMMARY OF THE INVENTION

The fuel enhancement device of this invention is adopted for positioning in flow communication along the motor vehicle fuel line. The device includes a canister which is connected to the fuel line, and which includes an inlet and an outlet separated by an internal chamber. The inlet and outlet are coupled to the fuel line upstream of the combustion chamber, normally a carburetor or fuel injector system.

A catalytic metal is housed in the canister chamber. Typically, the catalytic metal is formed as a plurality of rounded cones which are aligned symmetrically within the chamber and are carried in a metal mesh sleeve. As the fuel passes through the canister chamber, it contacts the catalytic metal to alter its molecular structure and improve combustion in the chamber.

The catalytic metals are preferably formed from an alloy of tin, antimony and lead, and may also include quantities of copper and zinc. Alternatively, the catalytic metals may take on a two stage orientation, with the first set of metals comprised of the above metals, and the second set comprised of a copper/zinc alloy.

The catalytic metals may be formed in a rounded conical configuration and stacked inside the canister. This maximizes the surface area available to contact fuel passing through the canister. The catalytic metal masses may be housed within the canister in a mesh sleeve and may be held in the proper orientation through the use of permanent magnets.

Accordingly it is an object of this invention to provide a novel performance enhancement device for motor fuels.

Another object is to provide for a motor fuel performance enhancer which can be incorporated directly into a vehicle fuel line.

Another object is to provide for a motor fuel performance enhancer which increases fuel economy and reduces harmful exhaust emissions.

Another object is to provide for a motor fuel performance enhancer which is easily installed and has a long useful life.

Another object is to provide for a novel method of manufacturing a catalytic metal motor fuel performance enhancer.

Another object is to provide for a two-stage motor fuel performance enhancer.

Other objects will become available upon a reading of the following description.

DESCRIPTION OF THE PREFERRED EMBODIMENTS

The preferred embodiments herein described are not intended to be exhaustive or to limit the invention to the precise forms disclosed. They are chosen and described to explain the principles of the invention, and its application and practical use to best enable others to follow its teachings.

Figure 1:
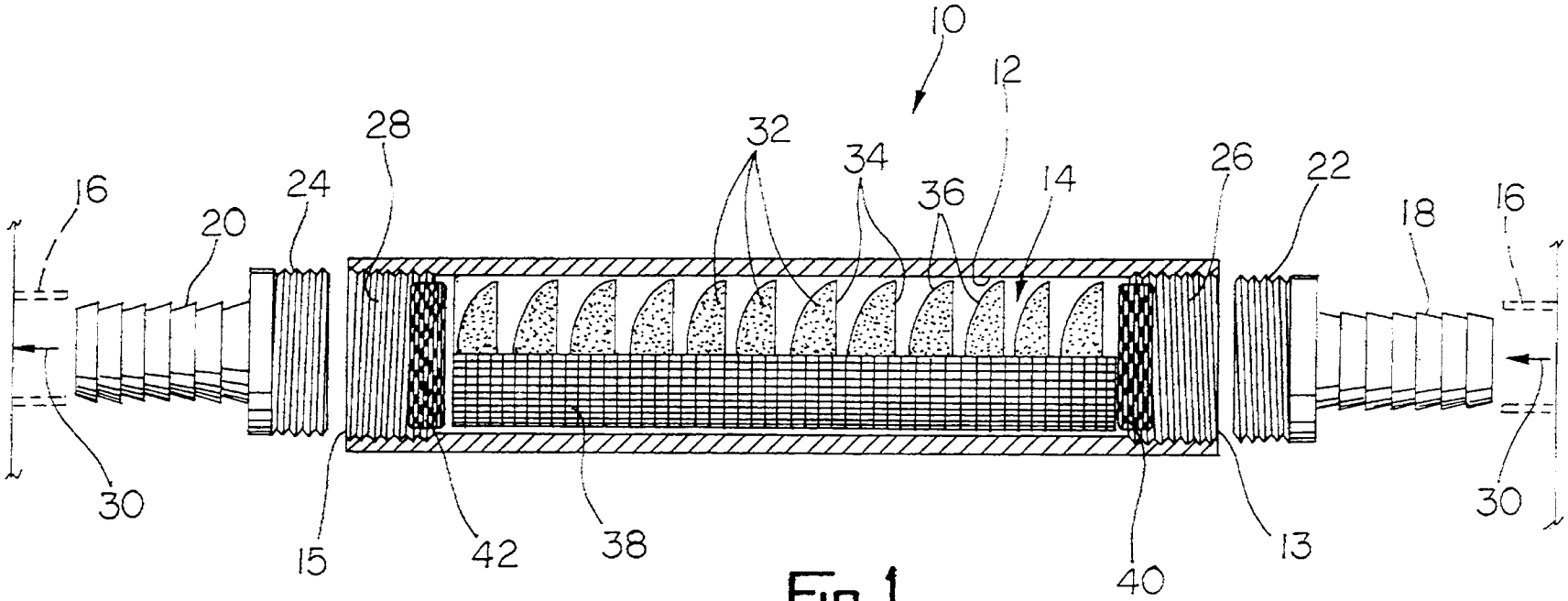
FIG. 1 is a partial exploded sectional view of a first embodiment of the motor fuel performance enhancer of this invention for use on passenger vehicles.
Figure 2:
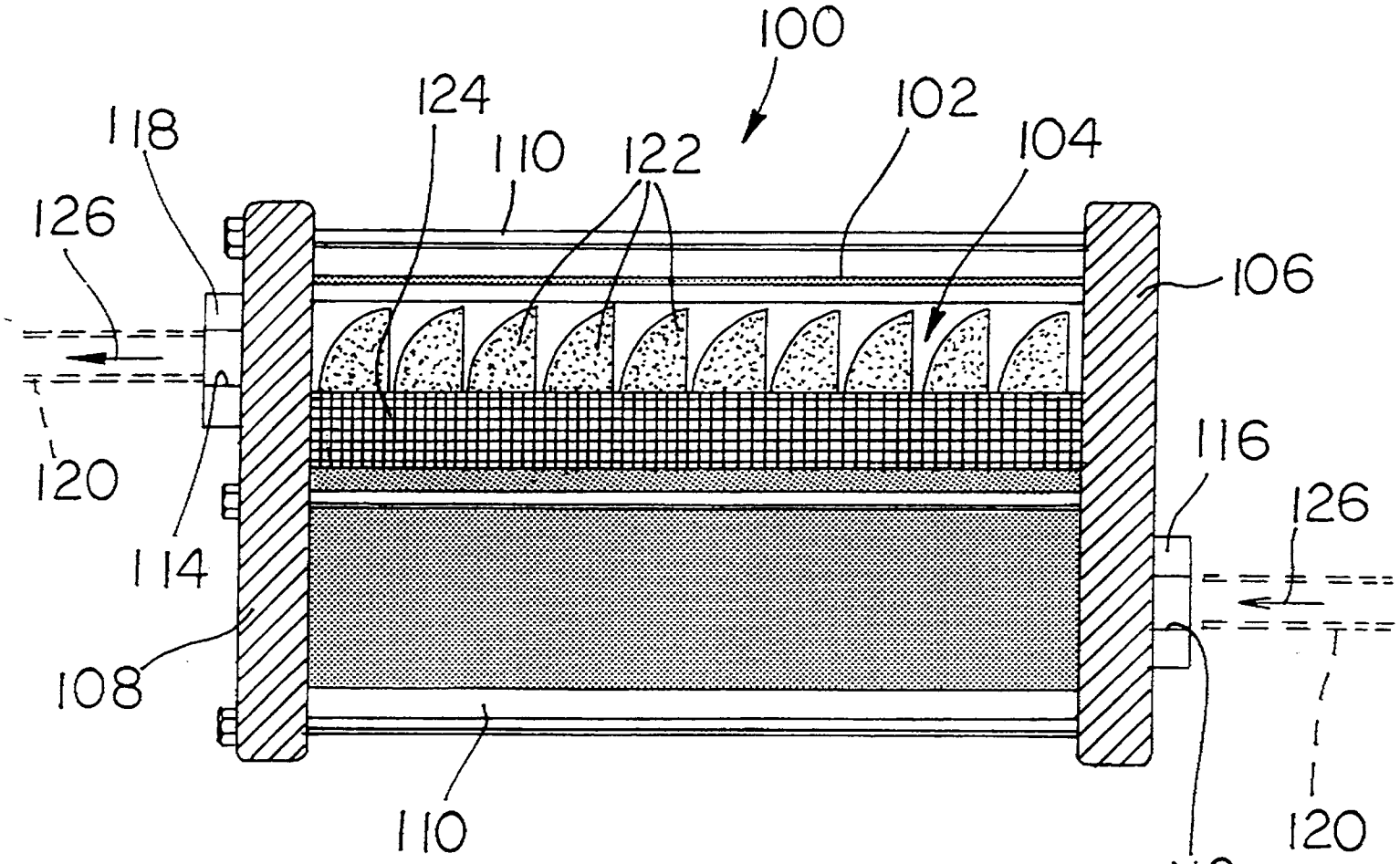
FIG. 2 is a partially exploded sectional view of a second embodiment of the motor fuel performance enhancer of this invention, as typically used on light trucks, vans or similar motor vehicles.

FIGS. 1 and 2 illustrate typical embodiments of the motor fuel performance enhancement device which form the subject matter of the present invention. Typically, the device 10 shown in FIG. 1 is particularly useful with passenger car engines, and the device 100 shown in FIG. 2 is particularly useful in light trucks, vans and similar vehicles.

Device 10, as shown in FIG. 1, typically includes canister 12 which is preferably a cylindrical tube formed of metal or metal alloy material. Canister 12 defines inner chamber 14. Canister 12 is adapted for connection to vehicle fuel line 16 as by fittings 18 and 20. Each fitting 18, 20 includes threads 22, 24, respectively which mate with threads 26, 28 at the opposite ends of canister 12. Appropriate seals (not shown) may be used in fastening fittings 18, 20 to fuel line 16 to prevent fluid leakage. Device 10 is connected to fuel line 16 at a point between the fuel storage tank (not shown) and the engine fuel combustion chamber (not shown). Fuel flow through canister chamber 14 is depicted by arrows 30.

Reference numeral 32 generally designates the catalytic metal masses which are housed within chamber 14. The makeup of the masses 32 is described in detail below. As shown, a plurality of metal masses 32 are housed in chamber 14. Each mass 32 is preferably of the rounded cone shape shown defined by a generally flat base 34 and rounded, tapering surface 36. Preferably, the masses 32 are positioned with each base 34 facing the inlet port 13 of canister 12 and the surface 36 facing outlet 15.

A generally cylinder sleeve 38, preferably of the wire mesh construction shown surrounds masses 32 and serves to hold the masses in the preferred alignment during operation of the vehicle. Further, end located magnets 40 and 42 may be housed in chamber 14 as shown near inlet 13 and outlet 15 of chamber 14. Detailed operational features of device 10 are discussed below.

FIG. 2 illustrates a modified device 100 which is generally adapted for use in light duty trucks, vans and similar vehicles which generally possess larger and more powerful engines. Device 100 includes canister 102 which is generally a cylindrical tube which defines chamber 104. End plates 106 and 108 provide axial support for canister 102 and are connected as by bolts 110. Plate 106 defines inlet port 112 and plate 108 defines outlet port 114. Fittings 116 and 118 serve to connect the canister 102 to a vehicle fuel line 120. Seals (not shown) ensure against leakage during operation of the vehicle with device 100 connected.

Catalytic metal masses 122 are housed within canister chamber 104. Masses 122 are similar in configuration to masses 32 described above and are housed in chamber 104 in a similar fashion. Two or more stacks of catalytic masses 122 are generally positioned in chamber 104 and are surrounded by wire mesh screen 124. Fuel flow through canister 102 is as indicated by arrows 126.

Catalytic metal masses 32 and 122 are formed so as to alter the structure of the fuel which flows through canister chamber 14 or 104 at the molecular level. Each catalytic metal mass is preferably comprised of an alloy of at least three metals, namely tin, antimony and lead. Additionally, quantities of zinc and copper may be added to the mixture.

Masses 32 and 122 may all be of a similar alloy or may be comprised of different alloys all within the boundaries of the set weight percentages defined below. A typical catalytic metal mass will contain between 35%–80% by weight tin, 10%–15% by weight antimony, 3%–7% by weight lead, 0%–20% by weight zinc, and 0%–40% by weight copper.

The process of manufacturing catalytic metal masses 32 or 122 is as follows. Solid metals according to the above recipe are melted and poured into a mold which approximates the desired configuration of mass 32 or 122. The resulting metal mass is then placed in the mesh sleeve 38 or 124 and housed in canister chamber 14 or 104.

The following examples are indicative of the catalytic metal manufacturing process for device 10 or device 100.

EXAMPLE 1

Catalytic metal masses were formed by combining molten metals as follows:

80% by weight tin;

15% by weight antimony; and

5% by weight lead to form a homogenous liquid mass. The liquid was poured into molds defining a rounded conical configuration and allowed to cool to room temperature. Ten of the resulting catalytic metal masses were placed inside a 20/20×0.016" wire mesh sleeve and then inside of a steel canister. The canister was sealed at both ends by common fittings which define an inlet port and an outlet port through the canister.

EXAMPLE 2

The following molten metals were combined to form a homogenous liquid mass:

65% by weight tin;

15% by weight antimony;

15% by weight zinc; and

5% by weight lead.

The liquid was then poured into molds and after cooling was placed in the mesh sleeve and canister as described in Example 1 above.

EXAMPLE 3

The following molten metals were combined to form a homogenous liquid mass:

35% by weight tin;

35% by weight copper;

15% by weight antimony;

10% by weight zinc; and

5% by weight lead.

After pouring into the mold and cooling, the resulting masses were incorporated into the device as described above.

EXAMPLES 4–5

A two stage catalytic metal device is prepared by pouring the following molten metals into a mold and cooling to room temperature (all metals expressed as wt. %):

| Example No. | Tin | Antimony | Lead | Copper | Zinc | Nickel |
|---|---|---|---|---|---|---|
| 4 (Stage 1) | 65 | 15 | 5 | — | 15 | — |
| 4 (Stage 2) | — | — | — | 70 | — | 30 |
| 5 (Stage 1) | 35 | 10 | 5 | 40 | 10 | — |
| 5 (Stage 2) | — | — | — | 50 | — | — |

In each example the catalytic metal masses formed were placed in the 20/20×0.016" wire mesh sleeve and positioned inside the canister chamber as described above. Both stage 1 and stage 2 catalytic masses are incorporated into the canister to achieve a combination effect on the fuel passing through the canister.

A typical canister which contained catalytic masses according to Example 5 above was road tested by Compliance and Research Services, Inc., an approved laboratory testing facility of the U.S. Environmental Protection Agency. The test vehicle tested was a 1985 Dodge Caravan with an odometer reading of 94,558 miles. Fuel used during all tests was Exxon Supreme, 91–92 octane rating. The vehicle was first tested without the device installed according to an EPA approved test. At the conclusion of the first test, device 10 was installed and the test repeated after adding a additional 28 miles to the vehicle to precondition device 10. The identical route was taken in each test with the vehicle being operated under nearly identical conditions and in a nearly identical manner. In each test, exhaust emissions and fuel consumption were closely monitored with the following results: test #2 with the device 10 installed resulted in a 10% decrease in fuel consumption as opposed to test #1. Test #2 also resulted in a decrease in exhaust emissions as compared to test # 1 as follows:

Hydrocarbons—down 46%

Carbon monoxide—down 36.3%

Nitric Oxide—down 14.8%

In installing device 10 or 100 to a vehicle fuel line 16 or 120 common clamps or belts (not shown) are used to secure fittings 18, 20 or 116, 118 to the fuel line. Masses 32 or 122 should be positioned with the wide, flat base part facing fuel inlet 13 or 112 for maximum efficiency. In selecting the proper number of masses 32 or 122 for a given engine, maximum efficiency is generally obtained at one mass 32 per 20 bhp with device 10 and one mass 122 per 10 bhp with device 100.

Figure 3:
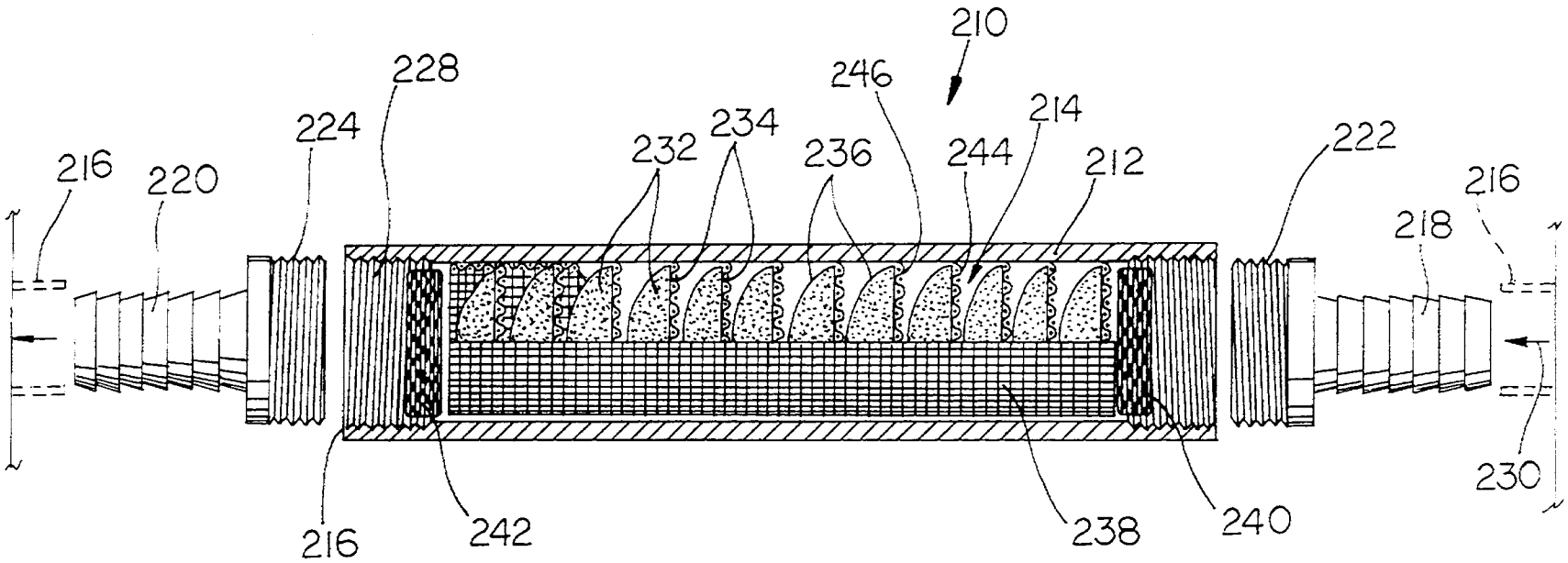
FIG. 3 is a view similar to FIG. 1 but illustrating a third embodiment of the present invention.

Referring now to the embodiment of FIG. 3, elements substantially the same as those in the embodiment of FIG. 1 retain the same reference numeral, but increased by 200. The presence of metals, such as steel or zinc, adjacent the catalytic masses 232 appears to increase the effect of the masses on the fuel being treated in device 210. Accordingly, the mesh screen 238 increases the catalytic effect of the masses 232, since the mesh screen 238 is made out of unfinished steel and surrounds the catalytic masses 232 and is in partial contact with them. To further add metal adjacent to or engaging the catalytic masses 232, transversely extending discs generally indicated by the numeral 244 are placed between each of the catalytic masses 232. Each disc 244 has an outer circumferential edge 246 which engages the inner circumferential surface of the mesh sleeve 238. Accordingly, an additional mass of metal is placed adjacent each of the catalytic masses 232, and does not substantially impede flow of fuel through the device. It is theorized that the metal, the catalytic masses 232, and the fuel interact with each other in a complex manner which removes impurities from the fuel. The presence of the magnets 240, 242 appears to enhance this interaction, but the magnets have been eliminated in the device of FIGS. 2 and 5. Although the mesh sleeve 238 and disc 244 may be readily made of steel because of its availability, they may also be made out of zinc. In either case it is important that these metal masses be placed adjacent the catalytic masses 232.

Figure 4:
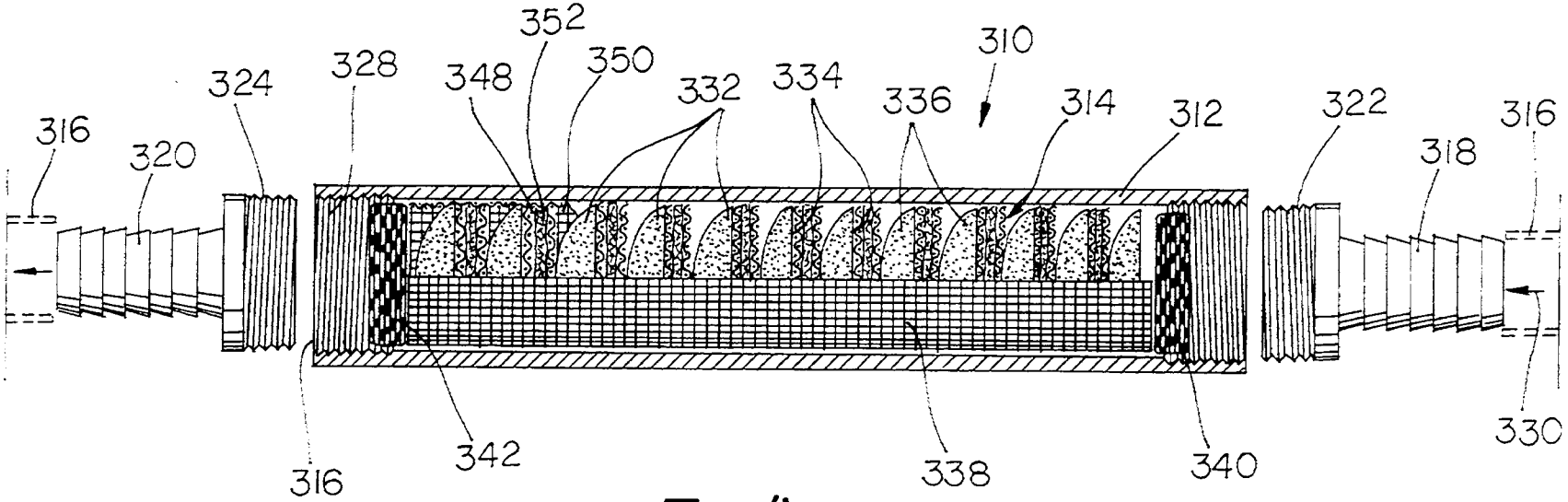
FIG. 4 is a view similar to FIG. 1, but illustrating a fourth embodiment of the present invention.

Referring now to embodiment of FIG. 4, elements the same or substantially the same as those in the embodiment of FIG. 1 maintain the same reference character, but are increased by 300. As discussed above with respect to the embodiment of FIG. 3, the presence of a mass of steel or zinc adjacent the catalytic masses 332 enhance the effect of the catalytic masses on the fuel being treated by the device 310. In the embodiment of FIG. 4, each of the masses 332 are separated by a pair of mesh discs 348, 350 with a disc 352 of foamed metal between the mesh discs 348, 350. The discs 348, 350 are made of the same wire mesh material as is the sleeve 338, and extend transversely across the inner diameter of the sleeve 338, the outer edges being supported by the sleeve 338. The sleeve 338 and each of the discs 348 and 350 are made from the same metallic material, which, as discussed above, may be either steel or zinc. The foamed metal disc 352 is made according to methods well known to those skilled in the art. The metal ingredient in the foamed metal disc 352 may be either copper or nickel, or a combination of the two. Again, the presence of these additional metals adjacent the catalytic masses 332 appear to enhance the ability of the masses to treat the fuel as it flows through the device 310.

Figure 5:
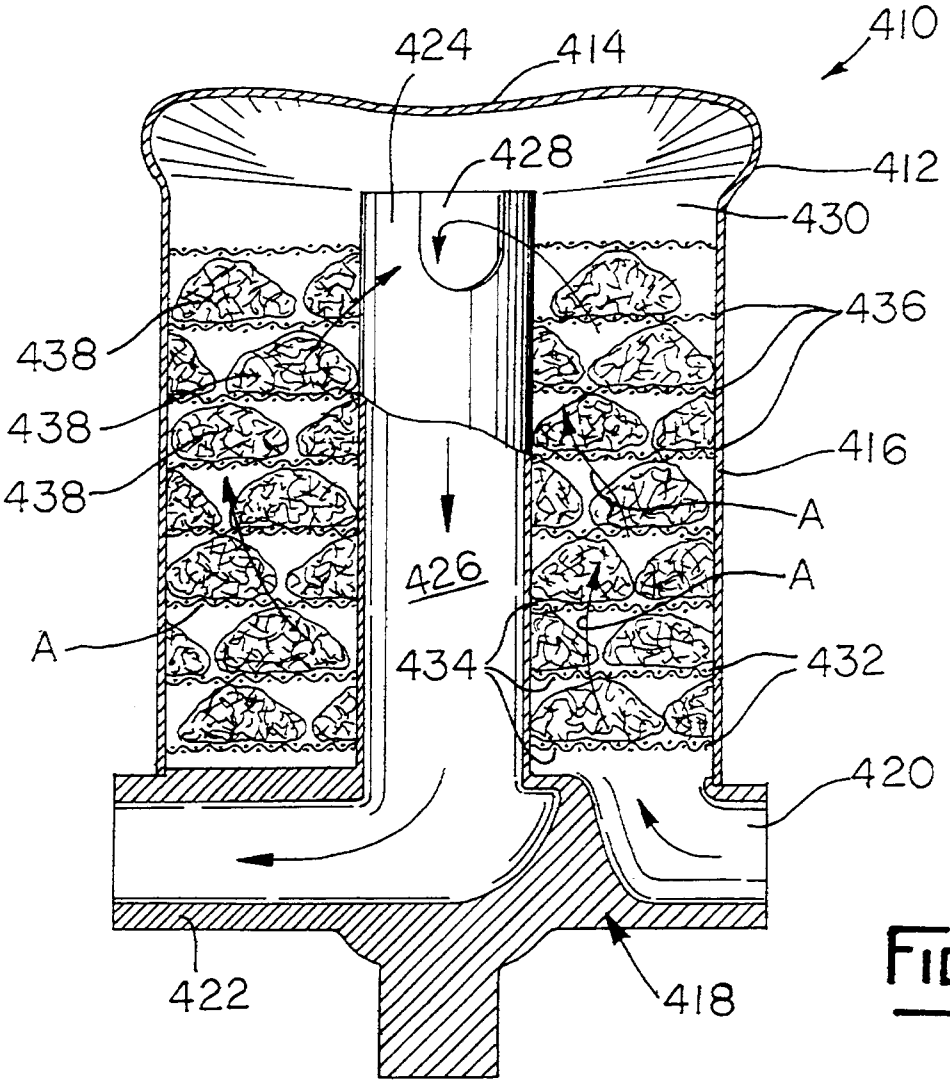
FIG. 5 is a cross sectional view of a fifth embodiment of the present invention.

Referring now to the embodiment of FIG. 5, device 410 includes a cup-shaped housing generally indicated by the numeral 412 which includes a closed end 414 and an outer circumferential wall 416 extending from the closed end 414. The open end of the housing 412 is enclosed by a closure member generally indicated by the numeral 418, which carries an inlet fitting 420 and an outlet fitting 422. Outlet fitting 422 communicates with a center tube 424 which projects from the closure member 414 and is coaxial with the wall 416. The center tube 424 defines a flow passage 426 which communicates with the outlet fitting 422. An aperture 428 communicates the passage 426 with annular chamber 430 defined between the wall 416 and the center tube 424. Multiple substantially parallel, axially spaced wire mesh screens 432 are mounted in the annular chamber 430 and are coaxial with the wall 416 and centertube 424. The inner edge 434 each of the screens 432 engages the center tube 424, and the outer circumferential edges 436 of the screens 432 engage the wall 416. Multiple catalyst masses 438, which are of the same general type described above for the embodiments of FIGS. 1 and 2, are placed on each of the screens 432 circumscribing the centertube 424. Accordingly, fuel flows into the inlet fitting 420, and then upwardly as indicated by the arrows A in FIG. 5 through the screens 432 and over the catalyst masses 438. Fuel then flows through aperture 428 into passage 426 within the center tube 424, and then out through the outlet fitting 422. It will be noted that the screens 432, as well as the housing 412, are made of uncoated metal, such as steel or zinc. The housing 412, as well as the screens 432, not only support the catalyst masses 438, but also provide the mass of metal adjacent the catalysts masses 438 that enhances the catalyst reaction with fuel as described hereinabove.

It is understood that the above description does not limit the invention to the precise details given, but may be modified within the scope of the following claims.

What is claimed:

1. Device for enhancing the performance of motor vehicle fuels, said device including an inlet fitting for connection to a supply of motor vehicle fuel and an outlet fitting for connection with a motor vehicle fuel and an outlet fitting for connection with a motor vehicle engine, said device defining a flow path between the inlet fitting and outlet fitting, a plurality of catalyst masses within said device in the flow path between the inlet fitting and outlet fitting, a circumferentially extending metallic member circumscribing said catalyst masses and defining a chamber containing said catalyst masses, and a transversely extending, perforated, metallic dividing means for dividing said circumferential edge engaging said metallic member, each of said sections containing a least one of said catalyst masses, said metallic member being a circumferentially extending mesh sleeve mounted within a housing carrying said inlet fitting and said outlet fitting.

2. Device as claimed in claim 1, wherein a plurality of said dividing means extend transversely across said sleeve, each of said catalyst masses being located between corresponding ones of said dividing means.

3. Device as claimed in claim 1, wherein each of said dividing means includes a mesh screen, each of said screens including a circumferentially extending edge secured to said metallic means.

4. Device as claimed in claim 3, wherein each of said dividing means further includes a pair of mesh screens with a disc of foam metal between each of said pairs of mesh screens.

5. Device as claimed in claim 3, wherein said metallic member and said screens are made of either steel or zinc.

6. Device as claimed in claim 3, wherein said metallic member is a circumferentially extending mesh sleeve mounted within a housing carrying said inlet fitting and said outlet fitting.

7. Device as claimed in claim 6, wherein multiple catalyst masses are located within said sleeve end-to-end with a mesh screen between each catalyst mass and adjacent catalyst masses.

8. Device as claimed in claim 3, wherein multiple catalyst masses are supported on each of multiple mesh screens within said metallic member.

9. Device as claimed in claim 8, wherein said metallic member is a fluid impermeable housing, each of said screens being coaxial with one another and with said housing.

10. Device as claimed in claim 9, wherein said flow path includes a centertube coaxial with said housing, each of said screens circumscribing said centertube.

11. Device as claimed in claim 10, wherein said centertube cooperates with said housing to define an annular chamber therebetween, said screens and said catalyst masses being located in said annular chamber.

12. Device as claimed in claim 11, wherein one of said fittings communicates with one end of the centertube, the other end of the centertube communicating with said annular chamber.

13. Device as claimed in claim 11, wherein one of said fittings communicates with the centertube, the other fitting communicating with said annular chamber, said annular chamber also communicating with said centertube, whereby said flowpath extends from said other fitting through said annular chamber to said centertube and from the centertube to said one fitting.

14. Device for enhancing the performance of motor vehicle fuels, said device including a housing having an inlet for connection to a supply of motor vehicle fuel and an outlet for connection with a motor vehicle engine, a metallic, circumferentially extending mesh sleeve within said housing between the inlet and outlet, and a catalyst mass within said sleeve in the flow path between the inlet and outlet, said sleeve contacting the fuel flowing between the inlet and outlet.

15. Device as claimed in claim 14, wherein a plurality of dividing means extend transversely across said sleeve, each of said catalyst masses being located between corresponding ones of said dividing means.

16. Device as claimed in claim 15, wherein each of said dividing means includes a mesh screen disc, each of said mesh screen disc including a circumferentially extending edge secured to said sleeve.

17. Device as claimed in claim 15, wherein each of said dividing means further includes a pair of mesh screen discs with a disc of foam metal between each of said pair of mesh screen discs.

18. Device as claimed in claim 17, wherein said metallic member and said mesh screen discs are made of either steel or zinc.

* * * * *